United States Patent [19]

Curtis

[11] 4,131,414

[45] Dec. 26, 1978

[54] LANTERN WITH KEROSENE PREHEATER

[75] Inventor: Richard D. Curtis, Wichita, Kans.

[73] Assignee: The Coleman Company, Inc., Wichita, Kans.

[21] Appl. No.: 795,710

[22] Filed: May 11, 1977

[51] Int. Cl.[2] ..... F21H 7/00

[52] U.S. Cl. ..... 431/104; 431/196; 431/236

[58] Field of Search ..... 431/104, 106, 107, 236, 431/195, 196, 237

[56] References Cited

U.S. PATENT DOCUMENTS

| | | | |
|---|---|---|---|
| 617,695 | 1/1899 | Boeck | 431/196 |
| 672,829 | 4/1901 | Goodwin | 431/104 |
| 779,064 | 1/1905 | Blanchard | 431/104 |
| 1,030,162 | 6/1912 | Conner | 431/104 |
| 1,312,108 | 8/1919 | Dewey | 431/196 |
| 1,447,842 | 3/1923 | Fowler | 431/195 |
| 2,183,273 | 12/1939 | Baker | 431/196 |

*Primary Examiner*—Carroll B. Dority, Jr.

[57] ABSTRACT

A cup is provided adjacent the generator tube of a kerosene lantern for holding a measured amount of fuel. A wick is located in the cup for burning the fuel at a controlled rate. A foraminous housing extends around and above the wick to control the entrainment of air with the fuel from the wick during burning and to direct the resulting flame against the generator tube thereby preheating fuel in the generator tube to its vaporization temperature until the heat of combustion of fuel at the mantle causes the vaporization of fuel in the generator to be self-sustaining.

3 Claims, 7 Drawing Figures

LANTERN WITH KEROSENE PREHEATER

BACKGROUND AND SUMMARY

The present invention relates to kerosene lanterns; and more particularly, it relates to apparatus for preheating the generator tube of a kerosene lantern with the capability of using kerosene as the preheating fuel.

Kerosene lanterns of the type with which the present invention is concerned have been known and commercial available for many years. Typically, kerosene is stored in a closed reservoir or fount which is pressurized with a hand pump. Liquid fuel is communicated through a valve to a generator tube in which the liquid fuel is heated to vaporization. The vaporized fuel is then fed to a mixing chamber of a Bunsen tube where the fuel vapor is mixed with air. The air/fuel mixture is fed through the Bunsen tube to a burner head for heating a mantle to produce light.

Kerosene lanterns are considered to be a convenient and safe source of light, and they operate reliably and well once equilibrium temperatures are attained for vaporizing the fuel in the generator tube and for burning adjacent the mantle. One of the main advantages of using kerosene, as distinguished from gasoline, for example, as a lantern fuel is that it has a relatively high vaporization temperature and is therefore safer in use. This characteristic, however, makes it difficult to vaporize the fuel in the generator tube during starting. This difficulty has been a major problem with kerosene lanterns since their early introduction. During normal operation the heat from the burner head or mantle is sufficient to cause a self-sustaining vaporization of the fuel in the generator tube.

A number of solutions has been suggested to overcome the starting problem. One approach (and perhaps the most common technique currently used commercially), is to employ a separate, more easily combustible fuel, such as alcohol, to be burned adjacent the generator tube, until it is heated sufficiently to sustain continuous operation. One disadvantage here is that it is cumbersome and dangerous to require a separate fuel. Further, there are objections in certain localities to the use of alcohol in this connection. Kerosene cannot be used as the auxiliary fuel in these structures for two reasons. First, when kerosene is burned in an open cup, the resulting flame is too small to preheat the generator sufficiently to cause self-sustaining operation. Secondly, such a flame is sooty; and the soot deposits on the interior of the glass surrounding the mantle, thereby diminishing the usable light from the lantern.

To overcome the requirement of an auxiliary fuel as described above, another commercial embodiment employs a separate blow torch which draws fuel from the main reservoir and directs the resulting flame onto the generator tube until it is sufficiently heated. The principal disadvantage to this structure is that the cost of the blow torch apparatus is substantial in relation to the overall cost of a kerosene lantern which is fairly modest. It will be appreciated that one of the principal uses of kerosene lanterns is to provide light in areas of the world where electrification has not taken place, and so the cost of a lantern is a significant factor in its commercial acceptability.

In co-owned U.S. Pat. No. 2,263,659, the pressurized air and fuel vapor mixture above the fuel in the fount is drawn off and discharged as an atomized mixture into a burner tube which is directed toward the generator tube to heat the generator. This system requires special atomizer apparatus, and it also requires that a person tend the lantern to turn off the preheat device once the generator tube has been sufficiently heated to vaporize the fuel within it.

In accordance with the present invention, an economical, yet convenient and reliable preheat apparatus is provided for a kerosene lantern and which is capable of using kerosene for the preheating fuel. A reservoir cup is provided adjacent the generator tube, and a measured amount of fuel, drawn from the fount, is deposited in the reservoir. A wick is located in the reservoir and is surrounded by a foraminous housing which extends around and above the wick. The wick is carefully tailored as to size and surface area, so as to burn a given quantity of fuel in a fixed amount of time. If the wick fails to burn a sufficient amount of fuel in the proper time, the generator will not be heated enough. If the wick burns too much fuel in this time, the foraminous housing can no longer entrain enough air. This results in a wide sooty flame which burns around the outside of the housing. A wide sooty flame will blacken the interior of the globe.

The foraminous housing is sized and shaped to operate in cooperation with the wick. The holes provide for a controlled entrainment of air with the vaporized fuel during burning. The shape and an upper aperture of the housing serve to direct the flame into a tall, narrow shape which envelops the generator. A small amount of soot is created by this tall narrow flame, but the soot exists above the top of the glass, and it is deposited on the underside of the lantern top. Therefore, the glass remains clean. Kerosene may thus be used as a preheating fuel.

Preferably, the apparatus includes some type of measuring dispenser such as an eyedropper or a rubber bulb syringe to deposit a precise, measured amount of fuel into the preheat reservoir. In the preferred embodiment, the measuring device is stored in the lantern collar. By using a measured amount of fuel, it is insured that the preheat apparatus burns long enough to heat the generator under the coldest conditions, and that the preheat fuel will burn out when the heat from the mantle is capable of vaporizing fuel in the generator.

Other features and advantages of the present invention will be apparent to persons skilled in the art from the following detailed description of a preferred embodiment accompanied by the attached drawing wherein identical reference numerals will refer to like parts in the various views.

THE DRAWING

DETAILED DESCRIPTION

Figure 2:
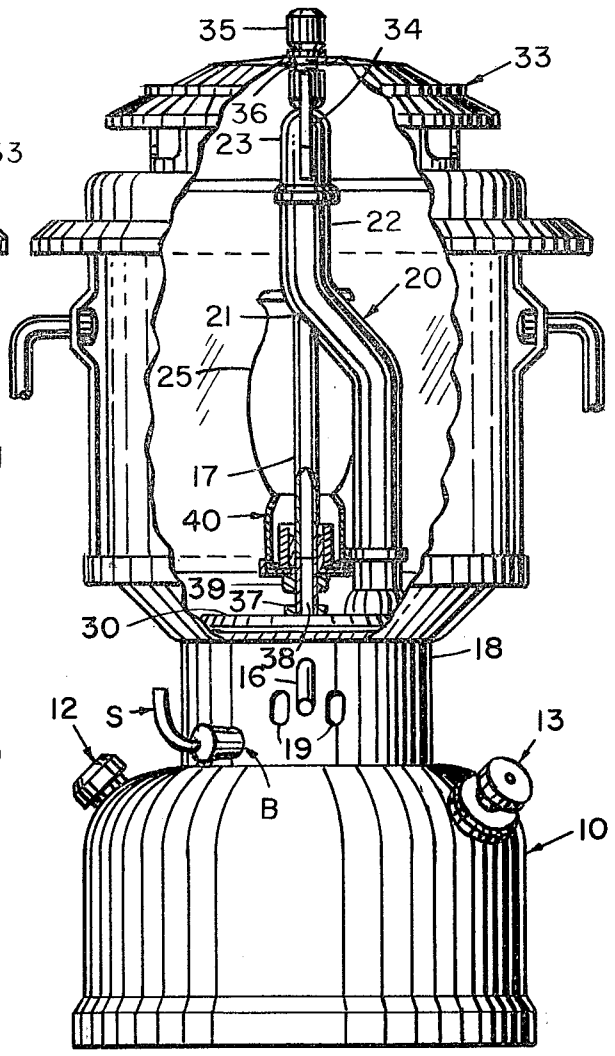
FIG. 2 is a vertical view of the lantern of FIG. 1 turned 90° to the left and with portions broken away to illustrate the invention.
Figure 1:
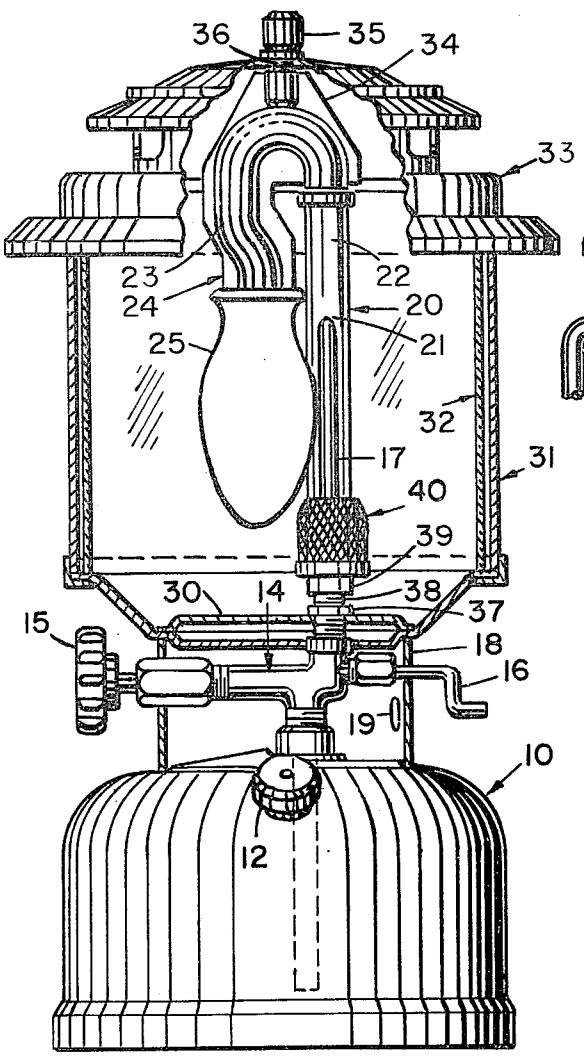
FIG. 1 is a vertical view, partly in section and partly broken away, of a kerosene lantern incorporating the present invention.

Referring to FIGS. 1 and 2, reference numeral 10 generally designates a fount or reservoir in which liquid fuel 11 (such as kerosene) is stored. The fuel is placed in the fount through a capped port 12.

Secured to the top of the fount 10 is a valve 14. The valve 14 is operated by a hand wheel 15, and it includes an orifice which may be cleaned by rotating a gas tip cleaning lever or crank 16. The valve 14 is housed in a collar 18 provided with apertures 19.

When opened, the valve 14 admits liquid fuel into the bottom of a generator tube 17 which extends upwardly and passes through the wall of a Bunsen burner tube 20 as at 21, the Bunsen burner tube being bent to receive the generator 17. Air for the tube 20 enters through apertures in collar 18.

The Bunsen burner tube defines a mixing portion 22 and is then curved downwardly at 23 to provide a burner head 24. A mantle 25 is attached to and suspended from the burner head 24.

Above the collar 18 is a baseplate 30; and a cage generally designated 31 is also supported by the collar 18. A glass globe 32 is mounted within the cage 31; and a top 33 is located above the cage 31 and globe 32. The top 33 is secured by means of a knurled nut 35 to a threaded stud 36 extending from the top of the bent portion 23 of the Bunsen burner tube 20.

Referring now to FIG. 1 in particular, the generator tube 17 is connected to the body of the valve 14 by means of a threaded nipple 38 and a generator nut 39. A thinner nut 37 is also received on the nipple 38; and it secures the baseplate 30 and cage 31 against the collar 18.

A preheat apparatus generally designate 40 is located at the base of the generator tube 17, and in this preferred embodiment, it extends completely about the generator tube for reasons that will be discussed presently.

Figure 4:
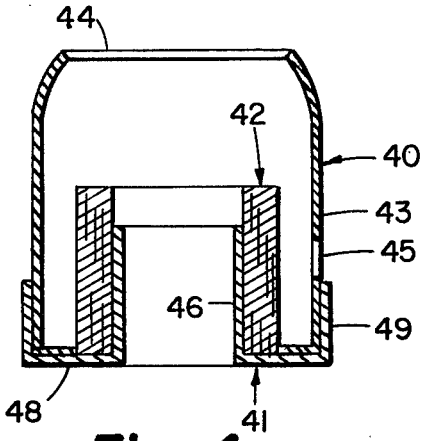
FIG. 4 is a vertical cross section view of the preheat apparatus of the lantern of FIG. 1.
Figure 6:
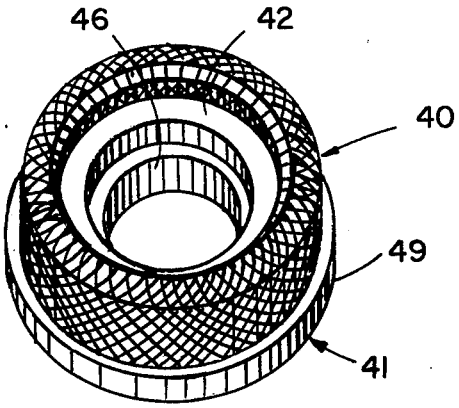
FIG. 6 is an upper perspective view of the preheat apparatus with the elements in assembled relation.
Figure 5:
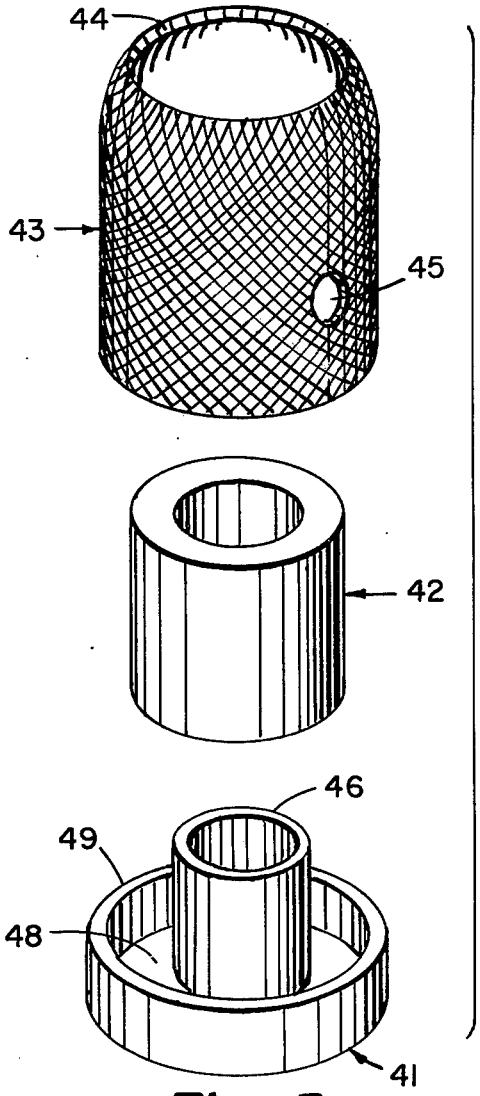
FIG. 5 is a perspective view of the preheat apparatus with the elements in exploded relation.

Referring now to FIGS. 4–6, the preheat apparatus 40 includes an annular cup or reservoir 41, an annular wick 42 received in the cup 41, and a foraminous housing 43 which defines a larger aperture 44 at its top.

The cup 41 has a cylindrical inner wall 46 which fits about the base of the generator tube 17 over the generator nut 39, a flat bottom wall 48 (which rests on nut 37), and a cylindrical outer wall 49. The wick 42 is an important element of the preheat apparatus. The surface area of the wick is one element which controls and determines the burning rate of the preheat fuel deposited in the cup 41. In one example, design to preheat a generator tube on a commercial Lantern No. 206 manufactured by The Coleman Company, Inc. of Wichita, Kansas, the wick is made of alumina silicate having an inside diameter of 9/6 in., an outside diameter of 13/16 in., a height of $\frac{5}{8}$ in. and a controlled surface roughness.

The foraminous housing 43 extends upwardly from the outer cylindrical wall 49 of the reservoir, about the wick 42 and above it. Above the top of the wick, the foraminous element 43 narrows to define the opening 44. A lighting aperture 45 is formed in the side of the housing 43, adjacent the wick 42. In this embodiment, the foraminous element is a screen of 16 × 16 mesh. Other structures have, however, proven equally effective in accomplishing the overall purpose of entraining air with the fuel vapor from the wick to produce a controlled, complete burning of the preheat fuel.

Figure 7:
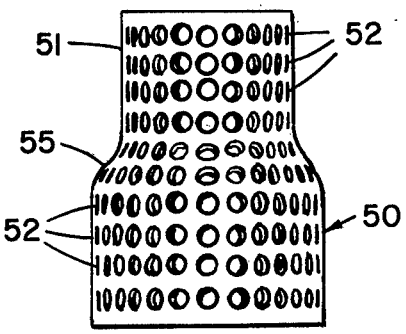
FIG. 7 is a side elevational view of an alternate foraminous housing which could be used in the preheat apparatus.

Another example of a foraminous element capable of performing this function is shown in FIG. 7, although any number of designs could equally well be used. Turning then to FIG. 7, the element includes a base 50 and an upper neck 51 of reduced diameter. Both the lower portion 50 and the neck 51 define a series of spaced, round apertures 52 which are arranged in a pattern, although this also is not necessary.

Figure 3:
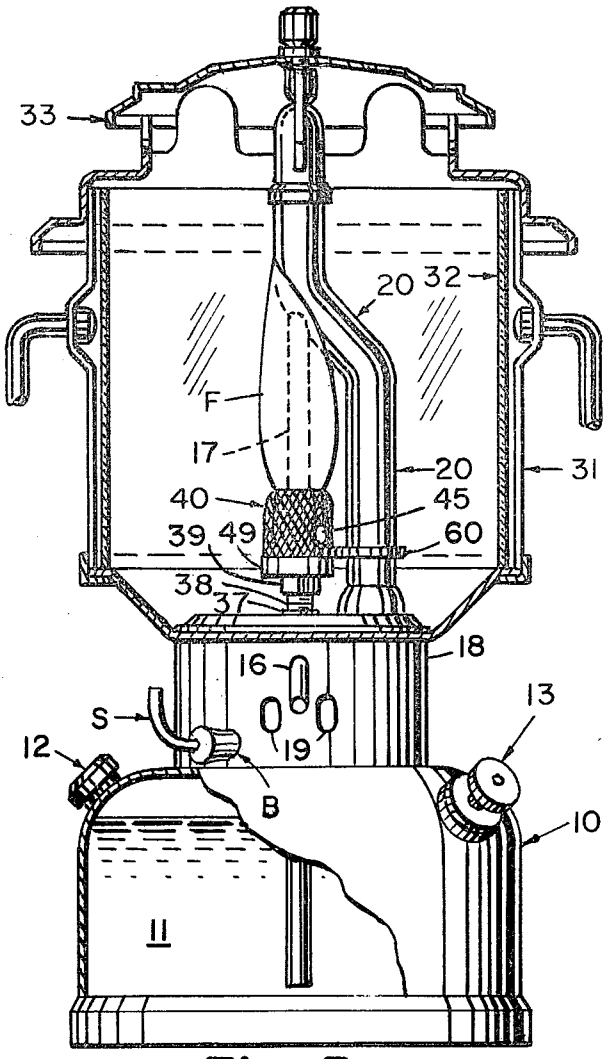
FIG. 3 is a view similar to FIG. 2 with portions in section and other portions broken away, and showing the preheat apparatus in operation.

It is desirable to have some reduction of the cross sectional area of the foraminous element above the wick as at 55 to direct the resulting flame F as seen in FIG. 3 about the generator tube 17 so that as much of the heat as possible liberated from the burning of the preheat fuel is available for heating the generator tube.

A measuring dispenser in the form of a dropper or syringe S with a rubber bulb B is held in the collar 18 of the lantern. A clip 60 snaps on the base of the Bunsen tube and extends over the outer wall 49 of the reservoir to hold the preheat apparatus in place.

OPERATION

When the lantern is cold, and it is desired to preheat the generator tube, the dropper S is inserted into the fount 10, and the bulb is fully depressed and released to draw a predetermined or measured quantity of fuel 11 from the fount. The tubular nose of the syringe is then inserted into the lighting hole 45 of the foraminous member 43 in the preheat apparatus. It will be observed that the hole 45 is located adjacent the wick so that the nose of the syringe engages the wick, thereby limiting the insertion of the syringe and insuring wetting the wick with fuel. For the size bulb shown, two bulbs full of fuel will supply the correct amount of preheat fuel.

The fuel, in measured quantity, is thus dispensed onto the body of the wick. In the illustrated embodiment, for the example given, about 1.5 cc. of kerosene are delivered by the dispenser syringe S onto the wick 42 and into the cub 41. The syringe is withdrawn after dispensing the fuel and placed back into the collar of the lantern. A lit match is then inserted into the aperture 45 to light the kerosene, and the resulting flame shown at F in FIG. 3 extends substantially the entire length of the generator tube 17.

The flame extends in a tall narrow configuration so that the globe 32 does not become sooty, and when the preheat fuel has been consumed (approximately 1.5 minutes), the person using the lantern actuates the valve 15, and fuel entering the fuse generator tube 19 will thereupon become vaporized. The vaporized fuel enters the Bunsen tube 20, mixes with air in the mixing chamber 22, and the mixture passes through the burner head 24 and into the mantel 25. Residual flame from the preheat apparatus ignites the fuel mixture at the mantel, and enough heat is then generated at the mantel to keep the generator tube operating in a self-sustaining mode.

In summary, the preheat apparatus of the present invention includes a wick placed in a reservoir and surrounded by a foraminous housing which extends above the wick and defines a discharge aperture 44 for producing a tall, narrow flame, and for directing that flame along a major portion of the length of the generator tube.

The wick is designed in size and surface area to burn a given quantity of fuel in a fixed time. If the wick fails to burn a sufficient amount of fuel in the proper time, not enough heat is liberated to obtain a self-sustaining vaporization in the generator tube. If too much fuel is burned, the foraminous housing will be unable to entrain enough air in the preheat apparatus, and a wide, sooty flame will burn around the exterior of the housing. The resulting soot will blacken the interior of the globe.

The foraminous housing is sized and shaped to cooperate with the size and shape of the wick to produce the desired flame shape and predetermined burning time. The apertures in the foraminous housing control the entrainment of air with the vaporized fuel during burning of the preheat fuel.

The present invention thus provides a simple, economical yet reliable means for preheating a generator tube of a kerosene lantern using kerosene as the preheat fuel but without the necessity of a blow torch or a separate fuel and without causing the globe of the lantern to become sooty during lighting. Depending upon the design of the lantern, the relationship between the surface area of the wick, the configuration and amount of opening in the foraminous element and the quantity of measured preheat fuel may have to be adjusted; however, such alterations are well within the skill of the art to achieve the objectives stated above.

Having thus described in detail one embodiment of the invention and shown an alternative form of foraminous element, persons skilled in the art will be able to modify certain of the structure which has been illustrated and to substitute other equivalent elements for those disclosed while continuing to practice the principle of the invention; and it is, therefore intended that all such modifications and substitutions be covered as they are embraced within the spirit and scope of the appended claims.

I claim:

1. A preheat apparatus for a kerosene lantern, the preheat apparatus comprising:

(a) a generator tube for vaporizing kerosene, (b) a generally annular cup surrounding said generator tube and having a bottom wall and inner and outer walls defining a reservoir, (c) a wick supported by the bottom wall of the cup for vaporizing kerosene, the wick having an outer surface which is spaced inwardly from the outer wall of the cup and extends above the outer wall of the cup to provide a vaporization space between the wick and the outer wall, and (d) a foraminous element surrounding the wick and extending above the wick for entraining air in the kerosene vapor which is vaporized by the wick, the foraminous element including a generally cylindrical portion which surrounds the wick and is spaced outwardly from the outer surface of the wick and an upper portion which extends above the wick and which is constricted inwardly for providing a flame opening, the size of the flame opening and the vaporizing area of the wick being such that the vaporized kerosene, when ignited, produces a tall, narrow flame which encompasses a major portion of the generator tube.

2. The apparatus of claim 1 in which said wick is provided by an annular piece of alumina silicate.

3. The apparatus of claim 1 in which said foraminous element is provided with a lighting opening at a position below the top of the wick.

* * * * *